United States Patent [19]

Lynch et al.

[11] 4,063,259

[45] Dec. 13, 1977

[54] METHOD OF MATCHING GOLFER WITH GOLF BALL, GOLF CLUB, OR STYLE OF PLAY

[75] Inventors: Francis deSales Lynch; Walter L. Reid, Jr., both of Mattapoisett; John W. Jepson, Marion, all of Mass.

[73] Assignee: Acushnet Company, New Bedford, Mass.

[21] Appl. No.: 626,712

[22] Filed: Oct. 29, 1975

[51] Int. Cl.[2] ..... G03B 1/00

[52] U.S. Cl. ..... 354/120; 354/76; 354/131; 354/132; 352/39; 35/29 A

[58] Field of Search ..... 354/34, 75, 76, 110, 354/120, 126, 127, 129, 131, 132, 137, 60, 354; 352/38, 39, 40, 44, 84; 273/32, 183 R, 184; 73/397; 283/1 R, 1 A; 35/29 A

[56] References Cited

U.S. PATENT DOCUMENTS

| | | | |
|---|---|---|---|
| 2,223,849 | 12/1940 | Fogler et al. | 352/84 |
| 2,382,981 | 8/1945 | Edgerton | 354/132 |
| 3,016,812 | 1/1962 | Chatlain | 352/39 |
| 3,173,348 | 3/1965 | Betinis | 352/39 |
| 3,820,133 | 6/1974 | Adorney et al. | 354/60 |
| 3,918,073 | 11/1975 | Henderson et al. | 352/84 |

OTHER PUBLICATIONS

The Focal Encyclopedia, pp. 275–277.

*Photography as a Tool,* Life Library of Photography, pp. 36–38, copyright 1970.

*Primary Examiner*—Russell E. Adams

*Attorney, Agent, or Firm*—Eyre, Mann, Lucas & Just

[57] ABSTRACT

A method of matching a golfer with golf balls with varying aerodynamic properties is disclosed. The "launch conditions" with which the golfer "launches" a golf ball are measured to determine the golf ball dimple pattern most suitable for a particular golfer or to determine modifications which should be made in his style of play or club design.

16 Claims, 5 Drawing Figures

METHOD OF MATCHING GOLFER WITH GOLF BALL, GOLF CLUB, OR STYLE OF PLAY

The present invention relates to a method of matching a golfer with a particular golf ball, style of play, or golf club design.

There has been much work done of late in the area of the aerodynamic properties of golf balls in order to improve the distance which a golfer will get from a golf ball. Claims have been made by a great number of companies that their particular golf ball is the best because it goes the furthest.

The applicants have now discovered that in addition to the aerodynamic properties (both in terms of dimple configuration and dimple arrangement) and structure of the golf ball, the "launch conditions" under which a given golf ball is put into the air have much to do with how far the ball will ultimately carry. The applicants have further discovered that these launch conditions will vary from golfer to golfer and that while with one set of launch conditions a golf ball with particular construction and particular aerodynamic properties will go the furthest, for another golfer with different launch conditions, the golf ball must have different aerodynamic properties in order to go the furthest. In addition, the applicants have found that certain ball constructions produce a change in golf ball carry for a given golfer as well as do different club head designs and styles of play.

The applicants have been able to translate these facts into a method for determining the ball that has the most desirable construction and aerodynamic properties for a particular golfer and also to determine the club design or style of play for a particular golfer. The applicants have discovered that this can be done by measuring the set of launch conditions for a given golfer with a given club and comparing this to charts of generated data for golf balls having varying constructions and dimple patterns. This set of launch conditions to be measured includes the launch angle, the spin velocity of the ball, and the initial velocity of the ball. When each of these values is measured for a particular golfer, when the golfer can be matched to a golf ball having the correct construction and aerodynamic properties for his particular set of launch conditions or the golfer's club design or style of play can be adjusted to suit his launch conditions.

Each of the foregoing measurements to be made will now be discussed in detail.

The launch angle of a ball is the angle the ball flight makes to the horizontal when it initially comes off the club face. While this launch angle can be measured with any single club in a set it is preferred to measure it with a plurality of different clubs. If only one measurement is to be made, it is preferred to measure this angle with a driver having a loft angle from about 9° to 13° and preferably of about 11°. While the driver will have a particular loft angle for its club face, this will generally not be the launch angle of that particular golfer. The particular golfer's launch angle will depend on such varying factors as where he places the golf ball with respect to his feet, the position of his hands when striking the ball and especially whether they are in "front" or "behind" the ball, the degree to which he has teed up the ball (if he tees up the ball) and the like and will be especially affected by the golfer's particular swing. The launch angle of a particular golfer is preferably measured by taking a series of pictures, preferably on a single photographic frame, of the ball flight during approximately the first one-tenth second after the ball leaves the club face and measuring the angle the flight path makes with the horizontal.

The spin velocity for a particular golfer is the velocity at which the golf ball is spinning immediately after it leaves the club head. It will be appreciated that this spin velocity will remain fairly constant over the first few tenths of a second after the golfer hits the golf ball due to the great flywheel effect of the golf ball as compared to the frictional forces with air which reduce the velocity of spin of the ball. We prefer to measure spin velocity over approximately the first one-tenth of a second after the ball leaves the head of the golf club by taking a series of sequential timed exposures on a single frame over the interval of time and computing the spin velocity of the golf ball from them. The spin velocity is computed by dividing the angle through which the ball rotates by the known time interval between ball exposures. It will be appreciated that spin velocity can vary with loft angle but the charts (described in detail, intra) used for matching a golfer with a golf ball compensate for this.

The initial velocity of the golf ball is the velocity of the golf ball at the time it leaves the club head of the golfer. This can be measured by sequential timed photographs or sensing devices in known manner. These measurements are well known in the art and are used by the U.S. Golf Association to measure the initial velocity of golf balls.

When the launch conditions of a particular golfer have been measured, the golfer can then be matched to a golf ball, golf club or particular style of play suited to that golfer. This can suitably be done by comparing the golfer's particular launch conditions with charts which have been made in advance for varying golf balls.

These and other features of the present invention can be more fully understood with reference to the drawings wherein.

Figure 1:
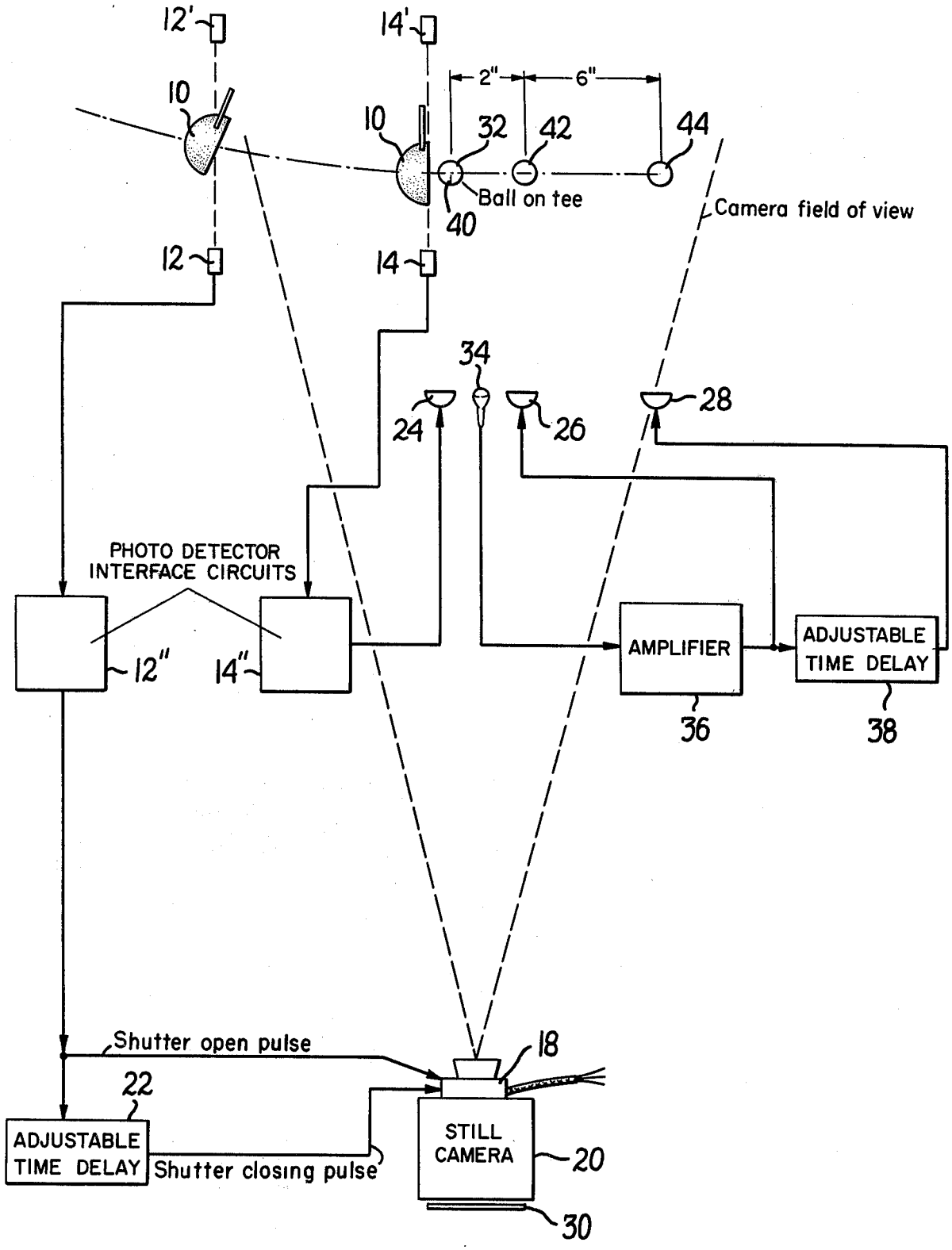
FIG. 1 shows an apparatus suitable for measuring a golfer's launch conditions in accordance with the present invention.

A golfer's launch conditions can suitably be measured by an apparatus such as that shown in FIG. 1. As there shown, a gold club head 10 passes between a series of photodetectors and corresponding light sources 12, 12' and 14, 14' respectively. Photodetectors 12 and 14 are connected to photodetector interface circuits 12" and 14" respectively. Circuit 12'-12-12" is activated when the club head 10 breaks the beam between light source 12' and photodetector 12. This causes simultaneous opening of the electrically activated shutter of the camera 20 and activation of time delay 22. The time delay 22 closes the shutter at a preselected interval (suitably one-sixieth to one-two hundredth of a second) after activation and is preferably made adjustable to compensate for varying time openings depending on the conditions needed.

Circuit 14'-14-14" activates, on interruption of the light beam by the club head 10, a flash of light from light source 24. Light source 24 and subsequent light sources 26 and 28 are suitably xenon lights with appropriate light intensity and short flash time duration. For shady ambient conditions, the intensity of the light source is preferably at least 10 million lux at 1 meter. For full sunlight, the intensity of the light source is preferably at least 100 million lux at 1 meter.

The duration of the flash is controlled to give essentially stop action of the club head and the golf ball. Because of the speed with which the club head and golf ball will normally be traveling, the duration of the flash is suitably no more than one ten-thousandth of a second and preferably no more than one-millionth of a second. Light source 24 produces an image of the club head 10 on the camera film 30 at the moment just before impact with the ball whereby the loft angle of the club can be measured as can the initial point in measuring launch angle.

When club head 10 strikes the golf ball 32, an audible "click" will be produced. This will be picked up by microphone 34 which will generate a signal increased in intensity by amplifier 36 for activation of light source 26 and time delay 38. The time delay, preselected for a given interval of time, activates light source 28, suitably 0.0005 to 0.005 seconds after activation of light source 26.

As shown, microphone 34 is spaced a suitable distance from golf ball 32. The purpose for this is to delay slightly the taking of the first image until the ball has resumed substantially its normal shape after compression by golf club head 10. For example, if microphone 34 is 13 inches away from the golf ball, then light source 26 will be activated approximately one-thousandth of a second after the golf ball contacts the face of the club head 10.

After light source 28 has been actuated, the electrically actuated shutter 18 closes due to time delay 22.

It will be appreciated that various modifications of the instant apparatus can be made. For example, microphone 34 can be replaced by a photodetector and light source. Similarly, the photodetectors can be replaced with other activating means such as light gauge wires which break upon club head impact and activate switches. Another modification would be to have amplifier 36 close the electrically actuated shutter 18 rather than having an adjustable time delay 32. Since an electrically actuated shutter will take approximately five one-thousands of a second to close, amplifier 36 could directly generate a shutter closing pulse and yet the shutter would remain open long enough to receive images from light sources 26 and 28.

After the sequence of events previously described is completed, the film is developed and the golfer's launch conditions are determined. It will be appreciated that since the angle with the horizontal between images created by light sources 26 and 28 will be virtually identical to the angle caused by the images from light sources 24 and 28, light source 24 is not a necessary part of the invention. However, it is considered to be quite beneficial since it shows the club head at the exact time of impact with the ball and will help to explain any erratic results obtained by factors such as the golfer's turning of the club head, hitting the ball towards the "toe" or "heel" or "high" or "low" on the club head or the like.

The golf ball 32 is provided with at least one mark 40 to assist in determination of spin velocity. Since the degrees of rotation of the ball between points 42 and 44 is known, and since the time interval from time delay 38 is known, the spin velocity can be computed. Similarly, the initial velocity of the ball can be computed from the distance traveled between points 42 and 44 and the set time of time delay 38. It will be appreciated that points 42 and 44 will vary slightly depending upon the speed at which the golf ball is traveling, it being kept in mind that light sources 26 and 28 are activated at a predetermined time.

While the foregoing apparatus is the preferred embodiment of the present invention, it will be appreciated that other apparatuses effective to record lineal (for determining initial velocity) and rotational (for determining initial spin velocity) position of the golf ball at timed intervals could also be employed. For example, line 40 could be replaced by radiation emitting dots which could activate receivers in the position of lights 26 and 28 (but closer to the ball) which receivers would in turn communicate the data to a suitable recording device such as a magnetic tape. Similarly, line 40 could be replaced by a strip of lead with an X-ray generator on one side of the ball and an X-ray receiving plate on the other side. The important feature of the apparatus of the present invention is that it be capable of recording the lineal position and the rotational position of a golf ball shortly after a golfer first hits the ball so that the golfer's launch conditions including initial velocity, initial spin velocity and launch angle can be determined.

Once a particular golfer's launch conditions are known, the launch conditions can be used to match the golfer with a particular golf ball construction and aerodynamic configuration, a particular style of play, or a particular club head design. In connection with the latter two features it will be appreciated, especially as described hereinafter, that light source 24 is quite beneficial.

Turning for the moment, however, to golf ball construction and aerodynamic properties, it has been found that golf balls will travel different distances depending upon their aerodynamic properties, their construction and the conditions under which they are launched. While it is true that each golf ball will be slightly different from any other golf ball even of the same brand and model, these differences are generally imperceptible unless a golf ball of substantially different aerodynamic design or substantially different construction is employed.

Figure 3:
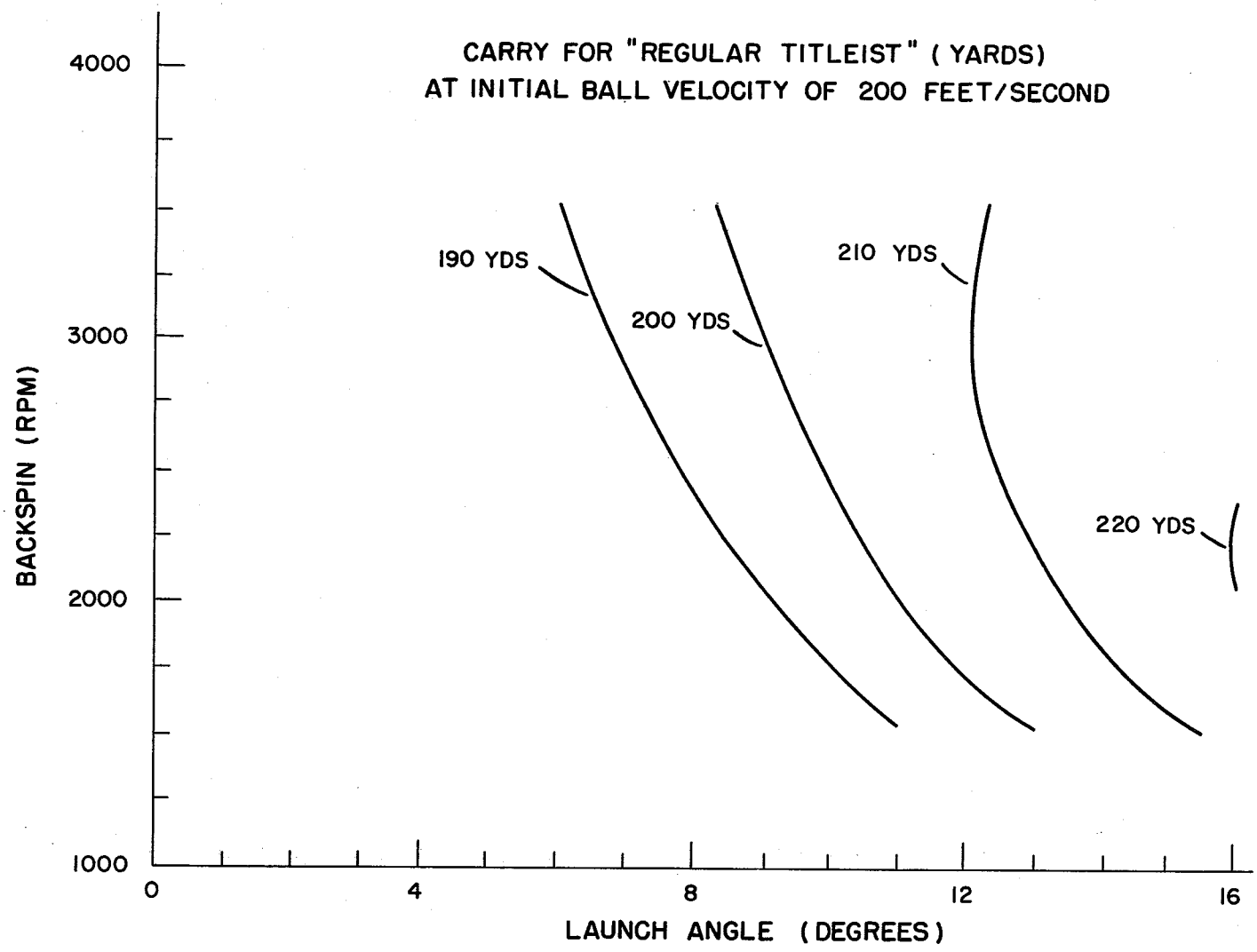
FIG. 3 is a chart showing golf ball carry for a particular golf ball under varying conditions.
Figure 4:
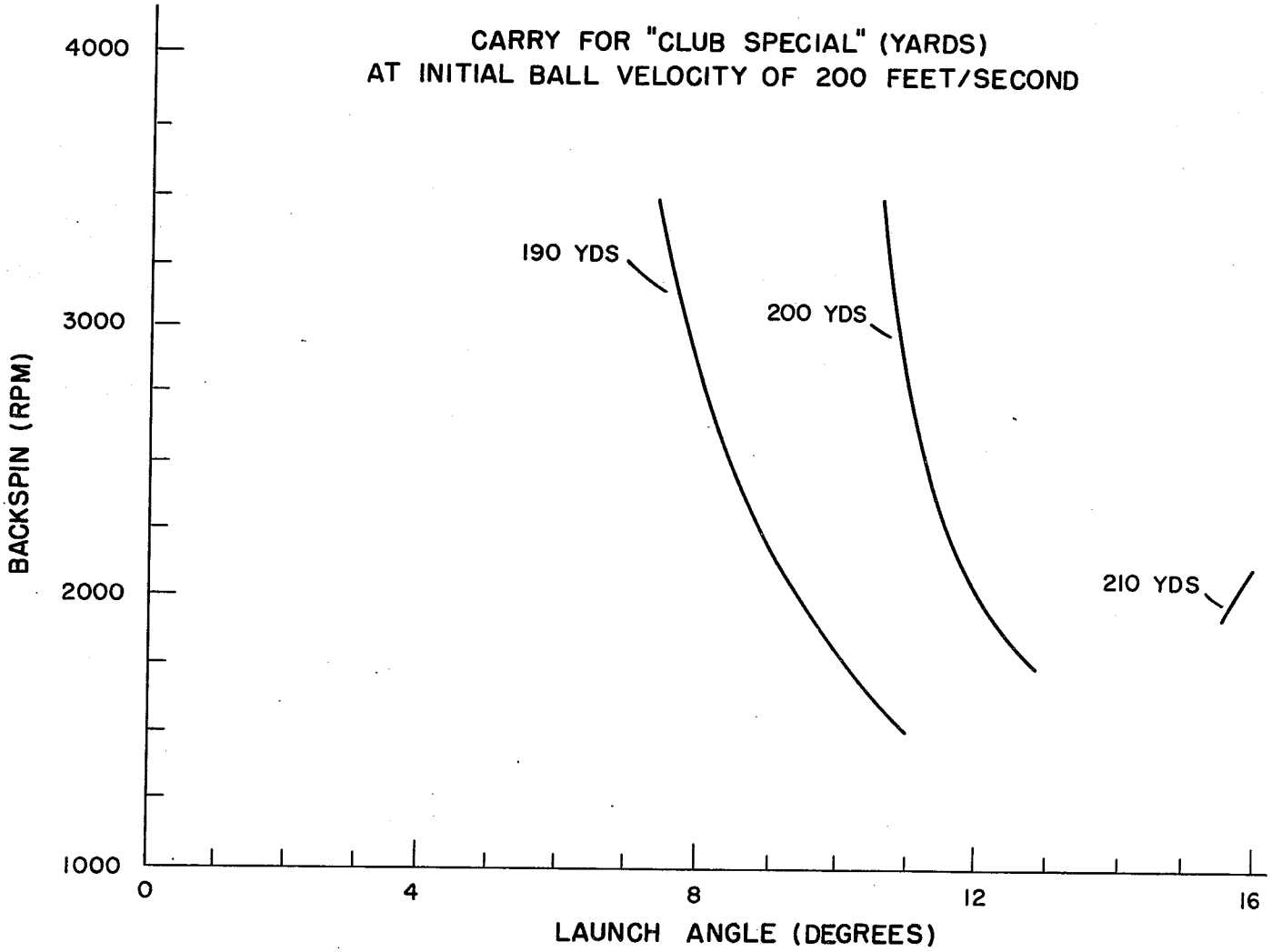
FIG. 4 is similar to FIG. 3 but for a different golf ball.

As one aspect of the present invention, charts are prepared for different golf balls showing the way in which they react to varying launch conditions. Two such golf ball charts are shown in FIGS. 3 and 4 of the drawings. The golf ball of FIG. 3 is a golf ball sold under the trademark TITLEIST by the Acushnet Company and identified by them as a "regular" TITLEIST golf ball. The golf ball of FIG. 4 is a golf ball sold under the trademark CLUB SPECIAL by the Acushnet Company.

In each chart, the abscissa is the spin velocity of the golf ball and the ordinate is the launch angle of the golf ball. In practice, a series of these charts are made up at varying initial velocity rates. In the particular charts shown, the initial velocity is 200 ft/sec.

Generation of the charts of FIGS. 3 and 4 and similar charts for other golf balls and for other initial velocities (suitably at 10 ft/sec intervals with intervening initial velocities handled by interpolation) can be done either mechanically or using analytical techniques. In the latter method, drag and lift coefficients for a given aerodynamic surface are measured using a wind tunnel and then a computer program is written solving the equations of motion for a spinning ball with these measured aerodynamic properties to compute the trajectory vs. time for a given set of launch conditions from which the distance that the ball will "travel" can be computed and plotted on the chart.

Figure 2:
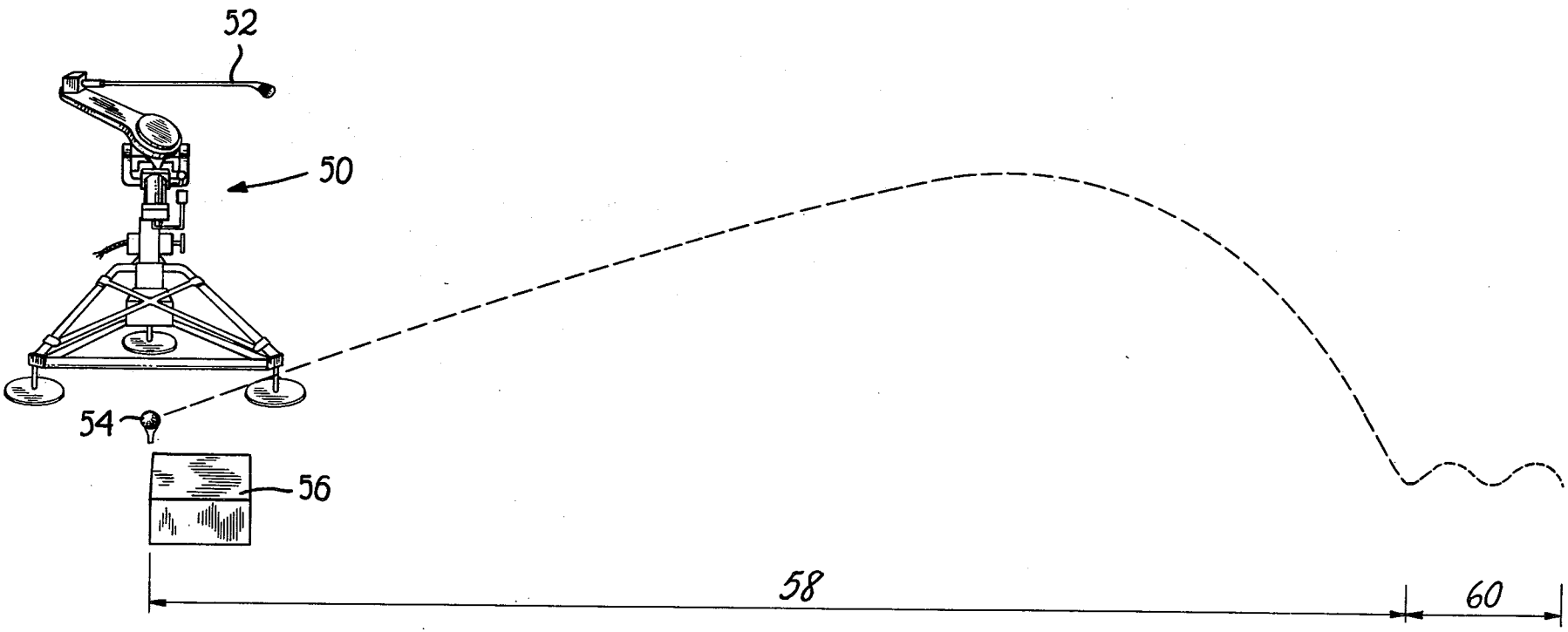
FIG. 2 is a schematic representation of the way in which the distance a golf ball travels is measured.

In FIG. 2 is shown the method of accomplishing the same result using mechanical means. An adjustable mechanical golfer 50 is used with a golf club 52 for striking a golf ball 54. A unit 56 such as the apparatus of FIG. 1 is used for determining the launch conditions of the golf ball. The mechanical golfer 50, suitably the mechanical golfer available from True Temper Corporation, is adjusted to give the launch angle, spin velocity and initial velocity desired for the particular test. The total travel of the golf ball 58 from the tee until the time it first reaches the "ground" on the same horizontal plane as the golf ball's initial starting position is measured and is plotted on the chart. As can be seen from the charts of FIGS. 3 and 4, varying launch conditions will result in the same golf ball traveling the same distance. Note that any "roll" of the golf ball as indicated by 60 is not included in the measurements.

The data generated from the mechanical tests or by the analytical method is plotted on graphs such as shown in FIGS. 3 and 4, previously described. For example, in FIG. 3, a golf ball with a launch angle of 11° and an initial spin velocity of about 1,500 rpm at an initial velocity of 200 ft/sec went approximately 190 yards. The same is true of the same ball at the same initial velocity but with the initial spin velocity increased to 3,000 rpm and the launch angle decreased to about 7°.

Figure 5:
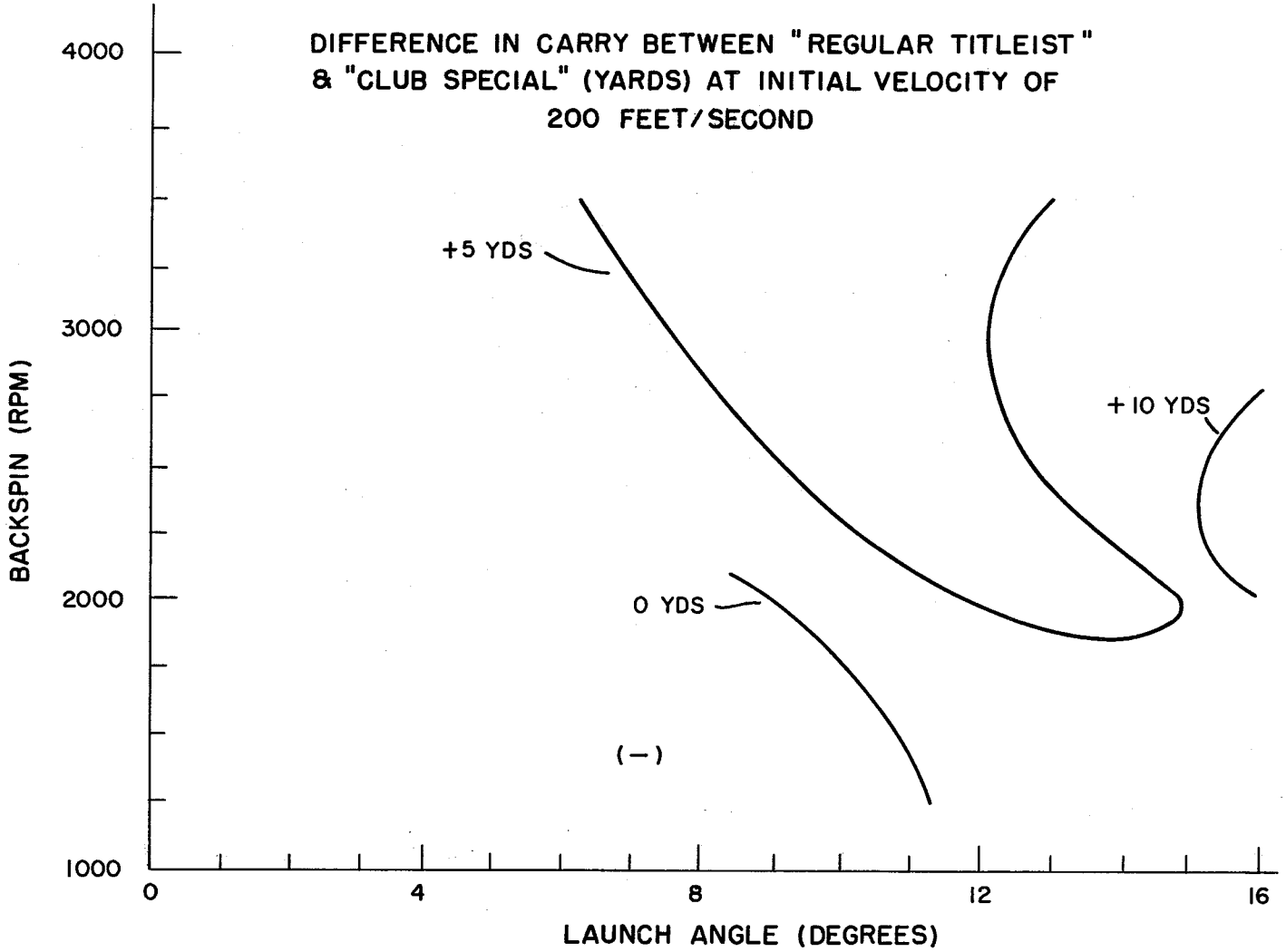
FIG. 5 is a comparison of the charts of FIGS. 3 and 4.

From charts such as those of FIGS. 3 and 4, comparative charts can be made for simplification such as that shown in FIG. 5. This chart shows the difference in carry between the ball of FIG. 3 and the ball of FIG. 4. As can be seen from the chart, a golfer having launch conditions including an initial velocity imparted to the ball of 200 ft/sec with a spin rate of 3,000 rpm and a launch angle of 8° will get about 5 yards more carry with the ball of FIG. 3 than he will with the ball of FIG. 4. Conversely, a golfer with the same initial velocity but a spin velocity of only 1,000 rpm and a launch angle of only 4° would get greater carry distance from the golf ball of FIG. 4 than he would from the golf ball of FIG. 3. Thus, it is seen that no one golf ball will give greatest distance under all launch conditions but rather the golf ball which a particular golfer should use depends upon his particular launch conditions. It should be noted, however, that most golfers have a launch angle of greater than 6° and a spin velocity greater than 2,000 rpm and therefore for most golfers the golf ball of FIG. 3 would give greater carry distance.

The charts generated in accordance with the present invention can be used in conjunction with a golfer's measured launch conditions to match the golfer with a particular golf ball or a particular playing style or golf club design best suited for that individual golfer. There follow examples showing the way in which this data can be used in each of these instances.

EXAMPLE 1

As an example of determining the golf ball for a golfer to use, the situation will be considered where a golfer's launch conditions have been measured and it has been found that he or she has an initial velocity of 200 ft/sec, an initial spin velocity of 3,000 rpm, and a launch angle of 8°. From a comparison of the results which this golfer would obtain with the golf ball of FIG. 3 as opposed to the golf ball of FIG. 4, it will be seen that this partcular golfer at these particular launch conditions will increase the carry of his or her drives by approximately 5 yards by using the golf ball of FIG. 3 rather than the golf ball of FIG. 4. This can be even more readily seen in FIG. 5.

EXAMPLE 2

As an example of determining a style better suited to the golfer, the situation will be considered where a golfer uses the golf ball of FIG. 3 and his or her measured launch conditions show that he or she has an initial velocity of 200 ft/sec, an initial spin velocity of 3,000 rpm, and a launch angle of 10°. Based on the chart of FIG. 3, one could suitably advise this golfer to tee his or her ball up slightly higher and hit more on the upswing. This would result in hitting the ball on the same spot on the club face, therefore getting the same ball velocity and spin rate, but the launch angle relative to the horizontal would be increased due to the club head traveling on a more upward path prior to impact. As can be seen from FIG. 3, an increase in launch angle of only a few degrees would yield 5–10 yards more carry.

EXAMPLE 3

As an example of determining a more suitable golf club design for a golfer, the situation will be considered where a golfer uses the golf ball of FIG. 3 and his or her measured launch conditions show that he has an initial velocity of 200 ft/sec, an initial spin velocity of 1,500 rpm, and a launch angle of 12°. Based on the chart of FIG. 3, one could advise this golfer that a club with 3° more loft angle (which would give him or her 2° to 3° more launch angle and approximately 25% more initial spin velocity) would result in added carry of approximately 10 yards. While this change would slightly reduce the golfer's initial velocity, thus reducing total carry somewhat, the golfer would obtain about a 7–8 yard total gain in carry. It is pointed out that the loss in carry from reduced initial velocity would require the use of another chart (not shown) for that reduced initial velocity in order to determine the actual carry which the golfer would obtain.

It will be understood that the claims are intended to cover all changes and modifications of the preferred embodiment of the invention, herein chosen for the purpose of illustration, which do not constitute departures from the spirit and scope of the invention.

What is claimed is:

1. An aid for golfers for use in matching a golfer to a golf ball, golf club or style of play which comprises:

a. a series of charts which compare initial velocity, initial spin velocity, launch angle and golf ball carry at a plurality of points for an at least one golf ball;

b. apparatus for measuring a golfer's launch conditions including initial velocity, initial spin velocity and launch angle when a golfer hits a golf ball with a golf club comprising;

i. recording means for recording the lineal position and the rotational position of the golf ball at a plurality of time intervals;

ii. first communicating means for communicating to the recording means the lineal position and the rotational position of the golf ball at a first point in time; and iii. second communicating means for communicating to the recording means, the lineal position and the rotational position of the golf ball at a second point in time subsequent to the said first point in time.

c. said launch condition measured by said apparatus for measuring being relatable to said series of charts.

2. An aid for golfers for use in matching a golfer to a golf ball, golf club or style of play which comprises:

a. a series of charts which compare initial velocity, initial spin velocity, launch angle and golf ball carry at a plurality of points for an at least one golf ball;

b. apparatus for measuring a golfer's launch conditions including initial velocity, initial spin velocity and launch angle when a golfer hits a golf ball with a golf club comprising;

i. a camera with an electronically operated shutter;

ii. means for generating an electrical signal to open the camera shutter when the golf club reaches a preselected position;

iii. means for generating a first flash of light after the golf club comes in contact with the ball;

iv. means for generating a second flash of light after the first flash of light;

v. means for controlling the interval between the first and second flashes of light; and vi. means for generating a signal to close the camera shutter;

c. said launch condition measured by said apparatus for measuring being relatable to said series of charts.

3. The apparatus of claim 2 wherein the means for generating a flash of light is a xenon lamp.

4. The apparatus of claim 3 wherein the xenon lamp has an intensity of at least 10 million lux at 1 meter.

5. The apparatus of claim 3 wherein the xenon lamp has an intensity of at least 100 million lux at 1 meter.

6. The apparatus of claim 3 wherein the duration of the flash is no more than one ten-thousandth of a second.

7. The apparatus of claim 3 wherein the duration of the flash is no more than one millionth of a second.

8. The apparatus of claim 2 wherein the means for generating an electrical signal to open the camera shutter comprises a light source and a photodetector.

9. The apparatus of claim 8 wherein a signal is generated from the photodetector to a time delay which generates the signal to close the camera shutter after a predetermined interval of time.

10. The apparatus of claim 9 wherein the preselected interval is from about one-sixtieth to about one-two hundredth of a second.

11. The apparatus of claim 2 further including means for activating the first flash of light.

12. The apparatus of claim 11 wherein the means for activating the first flash of light comprises a microphone and an amplifier circuit.

13. The apparatus of claim 12 wherein a signal from the amplifier circuit activates a time delay which in turn activates the second flash of light after a predetermined interval.

14. The apparatus of claim 13 wherein the predetermined interval is from about 0.0005 to about 0.005 seconds.

15. The apparatus of claim 2 further including means for generating a third flash of light before the first flash of light and at the moment just before the golf club comes in contact with the ball.

16. An apparatus for measuring a golfer's launch conditions when the golfer hits a golf ball with a golf club including:

i. initial velocity;

ii. initial spin velocity; and iii. launch angle; said apparatus comprising:

a. a camera with an electronically operated shutter;

b. means for generating an electrical signal to open the camera shutter when the golf club reaches a preselected position;

c. a xenon lamp having an intensity of at least 10 million lux at 1 meter for generating a first flash of light for a period of time no greater than about one ten-thousandth of a second after the golf club comes in contact with the ball;

d. a xenon lamp having an intensity of at least 10 million lux at 1 meter for generating a second flash of light for a period of time no greater than about one ten-thousandth of a second after the first flash of light;

e. a timer for controlling the interval between the first and second flashes of light between about one-sixtieth and about one two-hundredth of a second; and f. means for generating a signal to close the camera shutter at a preselected time after said second flash of light.

* * * * *